United States Patent [19]

Kamei et al.

[11] Patent Number: 4,971,467

[45] Date of Patent: Nov. 20, 1990

[54] PRINTER

[75] Inventors: Yuichi Kamei, Musashino; Yutaka Abe, Tokyo, Japan

[73] Assignee: Citizen Watch Co., Ltd., Tokyo, Japan

[21] Appl. No.: 298,350

[22] Filed: Jan. 17, 1989

[30] Foreign Application Priority Data

Jan. 28, 1988 [JP] Japan ..... 63-8832[U]

[51] Int. Cl.[5] ..... B41J 15/16; B41J 11/24

[52] U.S. Cl. ..... 400/611; 400/617; 400/636; 400/624; 400/185

[58] Field of Search ..... 400/611, 617, 634, 636, 400/641, 624, 625, 185; 192/41 S

[56] References Cited

U.S. PATENT DOCUMENTS

| | | | |
|---|---|---|---|
| 2,723,013 | 11/1955 | Rogers et al. | 192/41 S |
| 3,519,117 | 7/1970 | Smith | 400/641 |
| 3,618,721 | 11/1971 | Hare | 192/41 S |
| 4,440,280 | 4/1984 | Hagihara | 192/41 S |
| 4,787,764 | 11/1988 | Ikeda et al. | 400/634 |

*Primary Examiner*—Edgar S. Burr

*Assistant Examiner*—Motilal P. Patel

*Attorney, Agent, or Firm*—Lowe, Price, LeBlanc, Becker & Shur

[57] ABSTRACT

In a printer for printing information onto a recording medium, rotation of a platen in a normal direction causes the recording medium to be transported in a normal-feed direction. Rotation of the platen in a reverse direction causes the recording medium to be transported in a reverse-feed direction opposite to the normal-feed direction. Discharge rollers are arranged above the platen for rotation about an axis parallel to a longitudinal axis of the platen at respective peripheral speeds higher than that of the platen. A rotation transmitting mechanism is arranged between the platen and the discharge rollers for transmitting rotation of the platen to the discharge rollers. The rotation transmitting mechanism includes a one-way clutch for permitting rotation of the platen in the normal direction to be transmitted to the discharge rollers to rotate the same thereby feeding the recording medium in the normal-feed direction, but for preventing rotation of the platen in the reverse direction from being transmitted to the discharge rollers.

15 Claims, 8 Drawing Sheets

PRINTER

FIELD OF THE INVENTION

The present invention relates to a printer for printing information onto a recording medium.

BACKGROUND OF THE PRIOR ART

A printer as shown in FIGS. 1 and 2 of the accompanying drawings is known, and is so designed as to be connected to a host instrument such as a computer, a word-processor or the like, for printing information from the host instrument onto a recording medium P such as cut-sheets, a continuous form, a set of a plurality of superimposed copying sheets, or the like. The known printer comprises a rotatable platen 1, and a top cover 2 arranged above the platen 1 for movement between open and closed positions. A support shaft 6 is arranged between the platen 1 and the top cover 2 in parallel relation to a longitudinal axis of the platen 1. A plurality of spaced discharge rollers 3 are mounted on the support shaft 6 for rotation therewith in synchronism with the platen 1. The recording medium P is wound about the platen 1 and is clamped between the discharge rollers 3 and a plurality of guide ribs 4 provided on the top cover 2. Rotation of the platen 1 in a normal direction causes the recording medium P wound about the platen 1, to be transported in a normal-feed direction indicated by an arrow a in FIG. 2.

In the conventional printer described above. the discharge rollers 3 are so set as to have their respective peripheral speeds higher than that of the platen 1, to prevent the recording medium P from slackening between the platen 1 and the discharge rollers 3 when the recording medium P is transported in the normal-feed direction. Since, in this manner, the peripheral speed of each discharge roller 3 is set to a value higher than that of the platen 1, there arise the following problems. That is, when the platen 1 is rotated in a reverse direction opposite to the normal direction to transport the recording medium P in a reverse-feed direction indicated by an arrow b, the recording medium P tends to slacken between the discharge rollers 3 and the platen 1, resulting in such anxieties that the recording medium P is contaminated due to contact with the surrounding members or elements and that a bad influence is exerted upon an accuracy with which the recording medium P is fed.

SUMMARY OF THE INVENTION

It is an object of the invention to provide a printer capable of preventing a recording medium from slackening between a platen and discharge roller means when the recording medium is fed in a reverse-feed direction opposite to a normal-feed direction, thereby making it possible to avoid contamination of the recording medium due to contact thereof with the surrounding members or elements and to feed the recoring medium in the reverse-feed direction with high accuracy.

According to the invention, there is provided a printer for printing information onto a recording medium, comprising:

a platen about which the recording medium is wound, the platen being rotatable about its longitudinal axis in a normal direction and a reverse direction opposite to the normal direction, wherein rotation of the platen in the normal direction causes the recording medium to be transported along a predetermined transport path in a normal-feed direction, while rotation of the platen in the reverse direction causes the recording medium to be transported along the predetermined transport path in a reverse-feed direction opposite to the normal-feed direction;

means arranged adjacent the platen for printing the information onto a portion of the recording medium on the platen;

discharge roller means arranged above the platen for rotation about an axis parallel to the longitudinal axis of the platen at a peripheral speed higher than that of the platen, the predetermined transport path extending about the discharge roller means; and rotation transmitting means arranged between the platen and the discharge roller means for transmitting rotation of the platen to the discharge roller means, the rotation transmitting means including one-way clutch means for permitting rotation of the platen in the normal direction to be transmitted to the discharge roller means to rotate the same thereby feeding the recording medium in the normal-feed direction, but for preventing rotation of the platen in the reverse direction from being transmitted to the discharge roller means.

With the arrangement of the invention described above, when the recording medium is transported in the normal-feed direction, the discharge roller means rotated at the peripheral speed higher than that of the platen applies tension to a portion of the recording medium between the platen and the discharge roller means. On the other hand, when the recording medium is transported in the reverse-feed direction, the one-way clutch means prevents the rotation of the platen from being transmitted to the discharge roller means. Accordingly, the discharge roller means is rotated by the recording medium transported in the reverse-feed direction, to apply back-tension to the portion of the recording medium between the platen and the discharge roller means. Thus, the recording medium can be prevented from slackening between the platen and the discharge roller means, making it possible to eliminate contamination of the recording medium due to contact thereof with the surrounding members or elements and to feed the recording medium in the reverse-feed direction with high accuracy.

DETAILED DESCRIPTION

Figure 1:
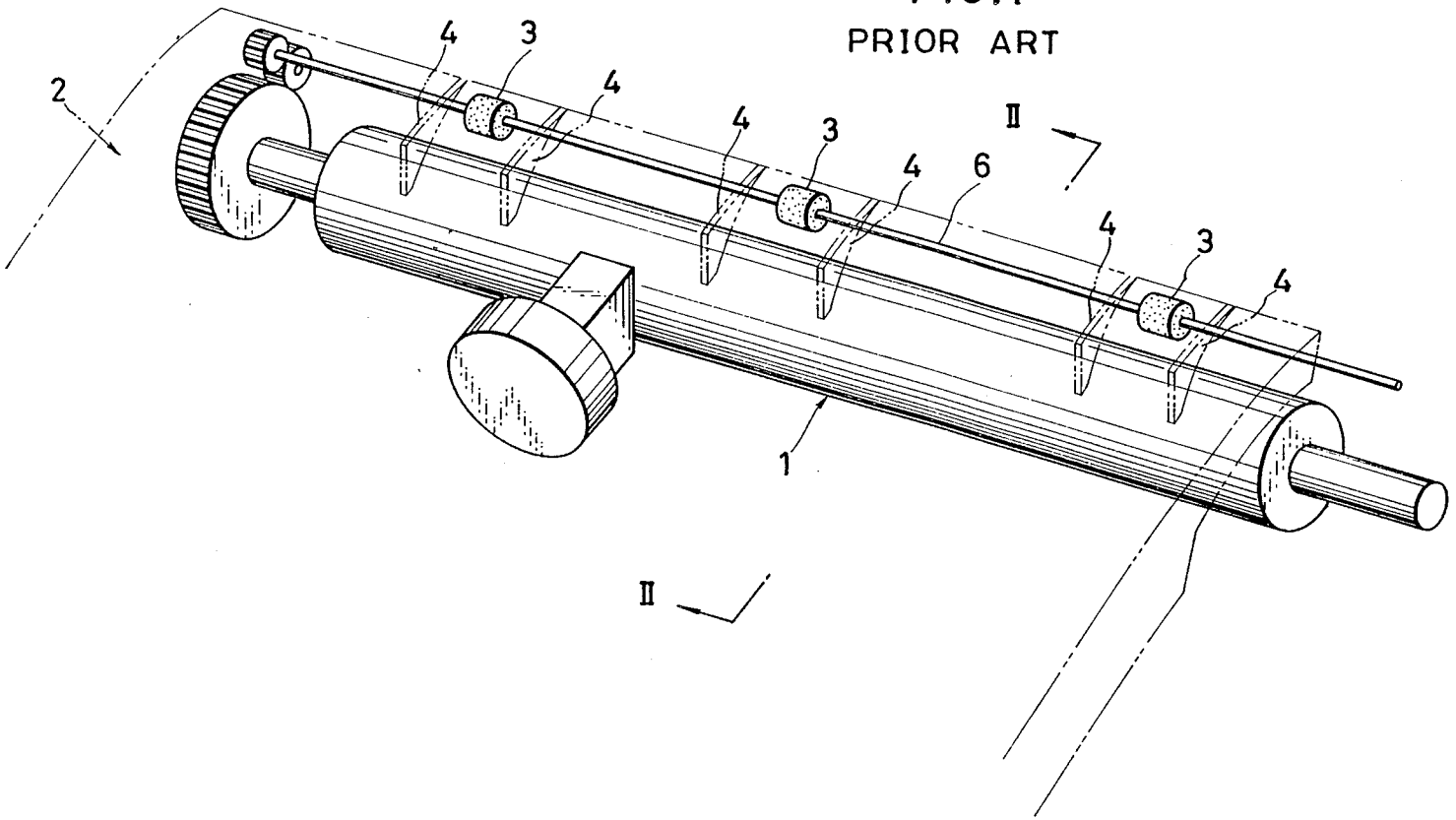
FIG. 1 PRIOR ART
FIG. 1 is a fragmentary perspective view of a conventional printer.
Figure 2:
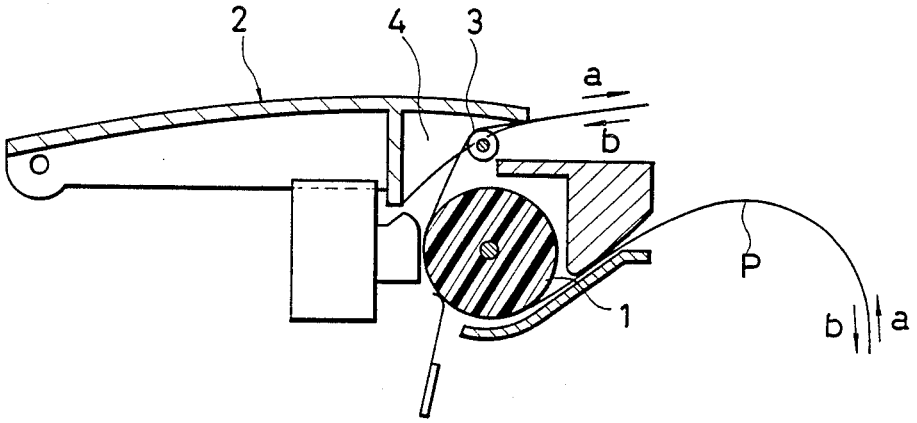
FIG. 2 PRIOR ART
FIG. 2 is a cross-sectional view taken along the line II—II in FIG. 1.
Figure 3:
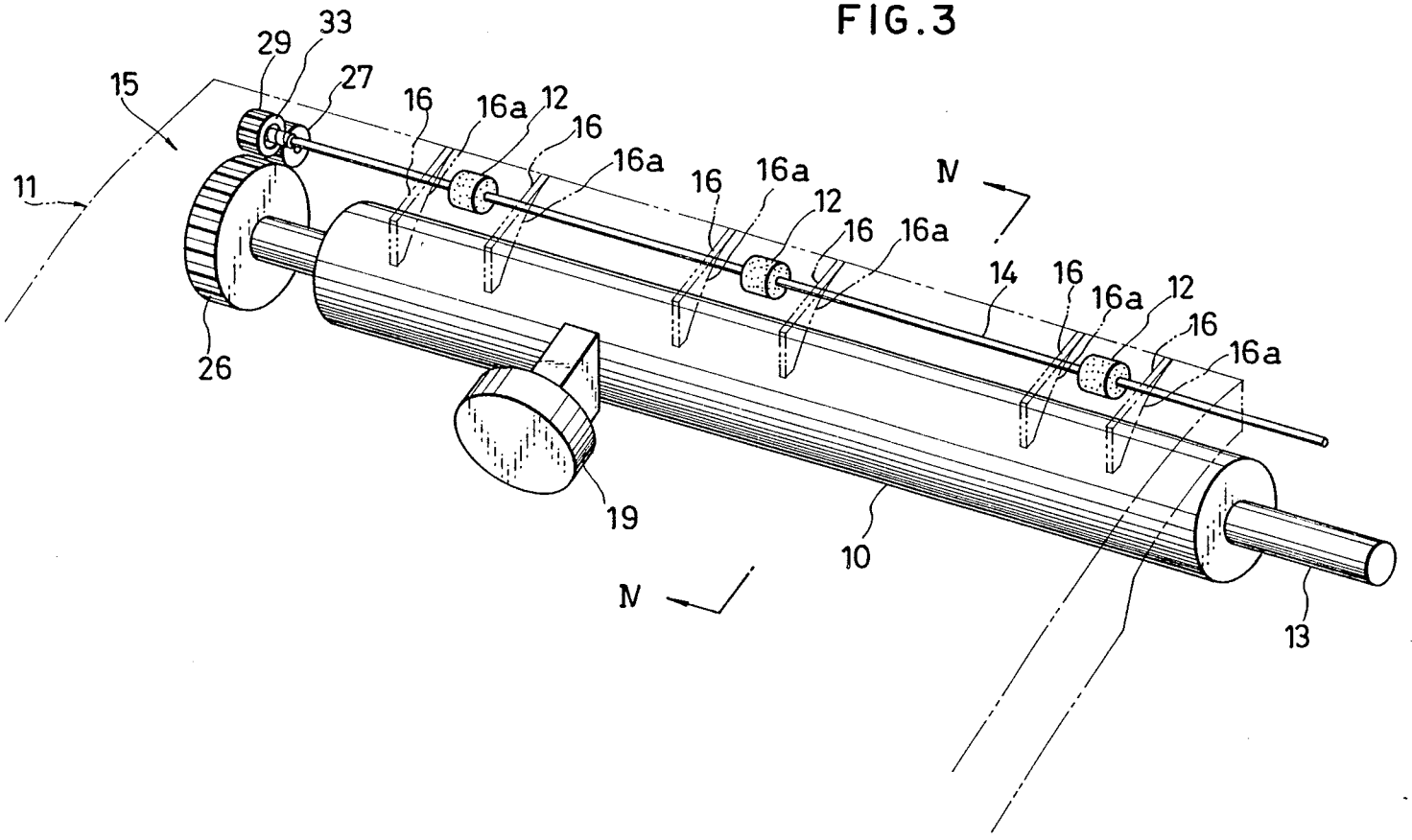
FIG. 3 is a fragmentary perspective view of a printer according to a preferred embodiment of the invention.

Referring to FIG. 3, there is shown a printer accordin to a preferred embodiment of the invention, for printing information outputted from a host instrument such as a computer, a word-processor or the like, onto a recording medium P such as cut-sheets, a continuous form, a set of a plurality of superimposed copying sheets. The printer comprises an elongated platen 10 which is circular in cross-section and which is mounted on a rotary shaft 13 for rotation therewith. A support shaft 14 is arranged above the platen 10 in parallel relation to an axis of the rotary shaft 13. A plurality of equidistantly spaced discharge rollers 12 are mounted on the support shaft 14 for rotation therewith at respective peripheral speeds higher than that of the platen 10 in synchronism with the latter. A rotation transmitting mechanism 15 is arranged between the rotary shaft 13 and the support shaft 14, for transmitting rotation of the platen 10 to the discharge rollers 12. The rotation transmitting mechanism 15 includes a one-way clutch to be described later.

Figure 4:
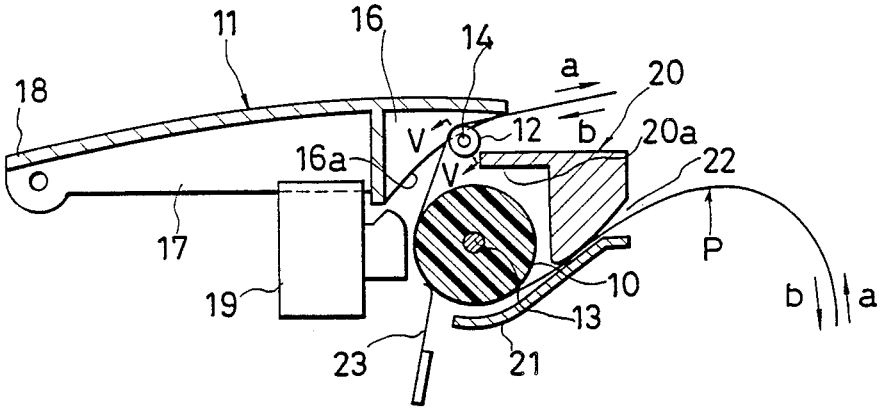
FIG. 4 is a cross-sectional view taken along the line IV—IV in FIG. 3.

A top cover 11 is arranged above the platen 10 with the support shaft 14 positioned between the top cover 11 and the platen 10. The top cover 11 is provided at its lower surface with a plurality of pairs of guide ribs 16 in an integral manner. Each guide rib 16 is generally triangular in shape in side elevation. The plurality of sets of guide ribs 16 are associated respectively with the discharge rollers 12 such that each roller 12 is arranged between a corresponding pair of guide ribs 16 and 16. An edge of each guide rib 16, which faces toward the platen 10, is formed into a curved guide surface **16*a*. As shown in FIG. 4, the top cover 11 is provided with opposite side plates 17 (only one shown), and is mounted to a printer body (not shown) for angular movement relative thereto between a closed position indicated by the solid lines in FIG. 4 and an open position indicated by the double-dotted lines, about a pair of pivots 18 (only one shown) attached respectively to the side plates 17. When the top cover 11 is in the closed position, the discharge rollers 12 cooperate with the guide ribs 16** to clamp therebetween the recording medium P.

As shown in FIG. 4, the recording medium P is wound about the platen 10. The platen 10 is rotatable about the axis of the rotary shaft 13 in a normal direction and a reverse direction opposite to the normal direction. Rotation of the platen 10 in the normal direction causes the recording medium P to be transported along a predetermined transport path in a normal-feed direction indicated by an arrow a in FIG. 4. On the other hand, rotation of the platen 10 in the reverse direction causes the recording medium P to be transported along the predetermined transport path in a reverse-feed direction indicated by an arrow b, which is opposite to the normal-feed direction a.

A printing head 19 is arranged adjacent the platen 10 for reciprocative movement along the rotary shaft 13, to print the information onto a portion of the recording medium P on the platen 10. A receiving section 20 for the recording medium P is provided in integral relation to the printer body, and is arranged adjacent the platen 10 on the opposite side of the latter from the printing head 19. The receiving section 20 is provided with a projection **20*a* extending horizontally toward a position between the platen 10 and the discharge rollers 12. A feed guide 21 is formed in integral relation to the printer body, and is arranged below the platen 10 and the receiving section 20. The feed guide 21 cooperates with the lower surface of the receiving section 20 to define therebetween a feed opening 22 for the recording medium P. A retainer 23 formed of, for example, spring material is arranged between the printing head 19 and the feed guide 21, for abutting the recording medium P wound about the platen 10, against the same. The above-mentioned predetermined transport path, along which the recording medium P is transported, extends from the feed opening 22 to the outside of the printer, along a part of the peripheral surface of the platen 10, through a printing position between the printing head 19 and the platen 10, and along parts of the peripheral surfaces of the respective discharge rollers 12**.

When the recording medium P such as the continuous form, the set of superimposed copying sheets or the like other than the cut-sheets is employed, a feed unit such as tractors or the like is arranged in facing relation to the feed opening 22.

Figure 5:
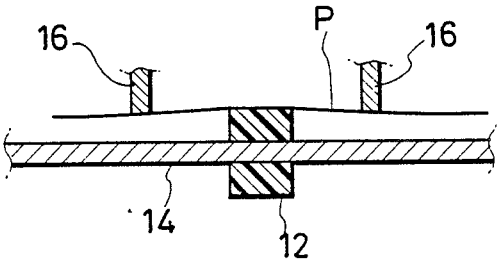
FIG. 5 is an enlarged cross-sectional view taken along the line V—V in FIG. 4.

As shown in FIG. 5, the discharge rollers 12 mounted on the support shaft 14 are so arranged that the radius of each discharge roller 12 is larger than the shortest straight distance between the central axis of the support shaft 14 and the curved guide surface **16*a* of each of the corresponding pair of guide ribs 16 and 16. With such arrangement, the recording medium P is biased under its elasticity or resiliency against the discharge rollers 12 so that the recording medium P is held between the outer peripheral surfaces of the respective discharge rollers 12 and the guide surfaces 16*a* of the respective guide ribs 16**.

Figure 6:
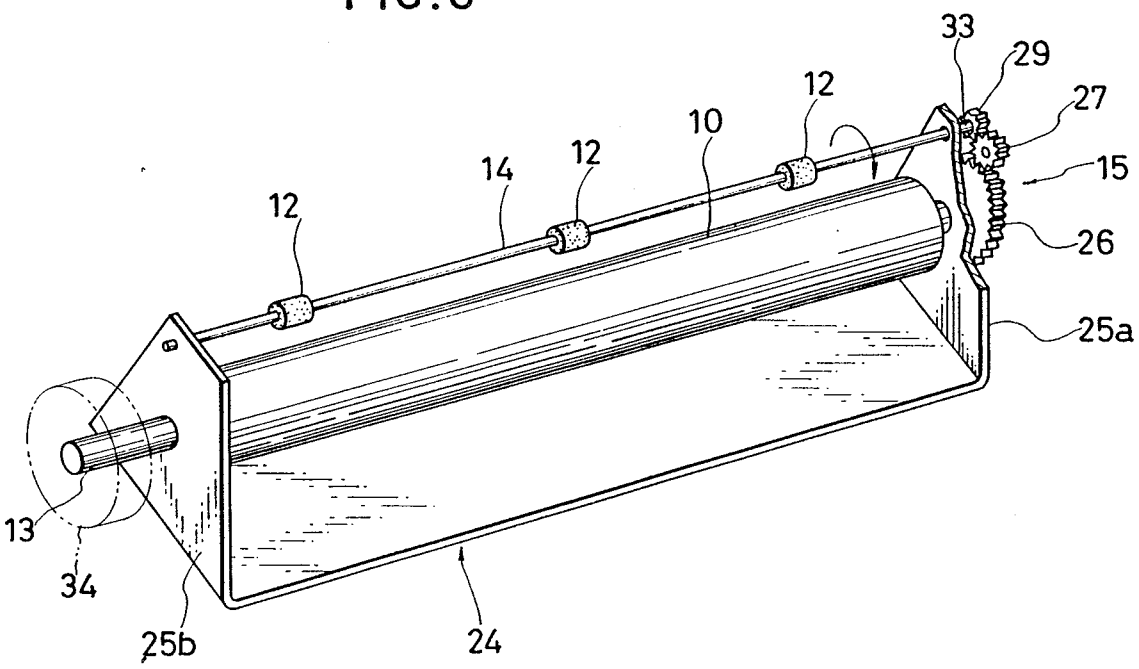
FIG. 6 is a perspective view of a rotation transmitting mechanism arranged between a platen and a support shaft for discharge rollers.

As shown in FIG. 6, the rotary shaft 13, on which the platen 10 is mounted, has opposite axial ends which are rotatably supported respectively by opposite side walls **25*a* and 25*b* of a frame 24 serving as a part of the printer body. The support shaft 14, on which the discharge rollers 12 are mounted, has opposite axial ends which are rotatably supported respectively by the side walls 25*a* and 25*b* of the frame 24. The above-mentioned rotation transmitting mechanism 15 comprises a gear train arranged between the rotary shaft 13 and the support shaft 14. The gear train includes a platen gear 26 which is mounted axially at one end of the rotary shaft 13 for rotation therewith. The platen gear 26 is drivingly connected to a drive motor (not shown) such that the platen gear 26 is rotated intermittently by a predetermined angular amount at a predetermined timing. A roller gear 29 is mounted axially at one end of the support shaft 14 for rotation therewith. An idle gear 27 is arranged between the platen gear 26 and the roller gear 29 for meshing relation thereto. A platen knob 34 is fixedly mounted axially on the other end of the rotary shaft 13 for the platen 10, for manually rotating the platen 10**.

Figure 7:
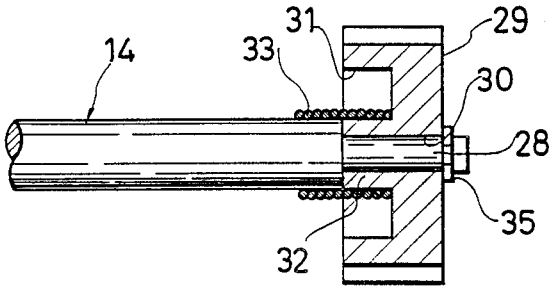
FIG. 7 is a partially cross-sectional, fragmentary enlarged vew of a one-way clutch of the rotation transmitting mechanism illustrated in FIG. 6.

As shown in FIG. 7, an end shaft section 28 extends axially from one end face of the support shaft 14 in coaxial relation to the body of the support shaft 14 and in integral relation thereto. The end shaft section 28 is fitted in a central through-bore 30 in the roller gear 29 in such a manner that the roller gear 29 is rotatable relatively to the end shaft section 28. The end shaft section 28 has an end which projects beyond an axial outer end face of the roller gear 29 remote from the body of the support shaft 14. The roller gear 29 is retained in position on the end shaft section 28 by an E-shaped retainer 35 which is engaged with the projecting end of the end shaft section 28. An annular recess 31 is formed in an axial outer end face of the roller gear 29 in concentric relation to the axis thereof. The annular recess 31 defined a boss 32 which has an axis extending in coaxial relation to the axis of the support shaft 14. The support shaft 14 and the roller gear 29 are connected to each other through a coil spring 33 which serves as the one-way clutch of the rotation transmitting mechanism 15.

In a free state of the coil spring 33 before the same is assembled with the roller gear 29 and the support shaft 14, an inner diameter of the coil spring 33 is smaller than an outer diameter of the support shaft 14 and an outer diameter of the boss 32 of the roller gear 29. The coil spring 33 is assembled with the roller gear 29 and the support shaft 14 in such a manner that one end of the body of the support shaft 14 is forcibly fitted axially into one end of the coil spring 33, and the boss 32 of the roller gear 29 is forcibly fitted in the other axial end of the coil spring 33. The winding direction of the coil spring 33 is so determined that when the recording medium P is transported in the normal-feed direction a as shown in FIG. 4, the coil spring 33 is tightened due to the friction force between the boss 32 of the rotating roller gear 29 and the coil spring 33, while when the recording medium P is transported in the reverse-feed direction b, the coil spring 33 is loosened due to the friction force between the boss 32 of the rotating roller gear 29 and the coil spring 33. That is, the coil spring 33 is so arranged that when the recording medium P is transported in the normal-feed direction a, the coil spring 33 is tightened to permit rotation of the roller gear 29 to be transmitted to the support shaft 14, while when the recording medium P is transported in the reverse-feed direction b, the coil spring 33 is loosened to prevent rotation of the roller gear 29 from being transmitted to the support shaft 14.

When the recording medium P is transported in the normal-feed direction a as shown in FIG. 4, rotation of the platen 10 in the normal direction is transmitted, as seen from FIG. 6, to the support shaft 14 through the rotation transmitting mechanism 15 which is composed of the platen gear 26, the idle gear 27, the roller gear 29 and the coil spring 33, so that the discharge rollers 12 mounted on the support shaft 14 are rotated in the same direction as the platen 10. Gear ratios among the gears 26, 27 and 29 are set in the following manner. That is, the discharge rollers 12 are rotated at respective peripheral speeds higher than that of the platen 10 when the recording medium P is transported in the normal-feed direction a, so that the feed amount of the recording medium P due to the discharge rollers 12 is slightly larger than that due to the platen 10.

It is to be understood that the one-way clutch is not limited to the coil spring 33 described above. The one-way clutch may be of any suitable type if the one-way clutch can transmit rotation of the platen 10 in one of the opposite directions to be transmitted to the support shaft 14, but prevent rotation of the platen 10 in the other direction from being transmitted to the support shaft 14. Further, the one-way clutch may be arranged in association with the idle gear 27. Furthermore, pulleys and a timing belt may be substituted for the gears 26, 27 and 29 of the rotation transmitting mechanism 15.

The operation of the printer constructed as above is described below.

Figure 8:
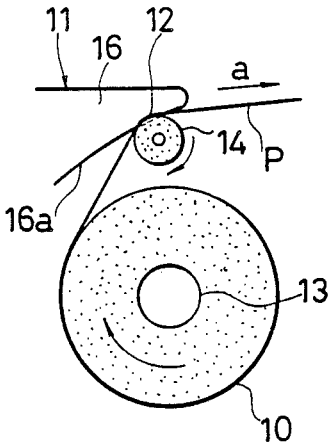
FIG. 8 is a view for explanation of a feed mode in which a recording medium is transported in a normal-feed direction by the platen illustrated in FIG. 4.

A normal-feed mode will first be described, in which the recording medium P is transported in the normal-feed direction a. When the platen gear 26 is rotatively driven by the drive motor, the platen 10 is rotated in the same clockwise direction in FIG. 8 as the rotational direction of the platen gear 26, together with the rotary shaft 13 on which the platen gear 26 is fixedly mounted. On the other hand, the idle gear 27 in mesh with the platen gear 26 is rotated in the counterclockwise direction opposite to the rotation direction of the platen gear 26. The roller gear 29 in mesh with the idle gear 27 is rotated in the same clockwise direction as the platen gear 26. Rotation of the roller gear 29 causes the coil spring 33 to be tightened so that the rotation of the roller gear 29 is transmitted to the support shaft 14 through the coil spring 33. Thus, the discharge rollers 12 mounted on the support shaft 14 are rotated at their respective peripheral speeds higher than that of the platen 10 in the same clockwise direction as the platen 10. The recording medium P wound about the platen 10 and held between the discharge rollers 12 and the guide surfaces **16*a* of the respective guide ribs 16 on the top cover 11 is transported in the normal-feed direction a. Since the rotating discharge rollers 12 apply tension to the portion of the recording medium P between the platen 10 and the discharge rollers 12, the recording medium P is prevented from slackening between the platen 10 and the discharge rollers 12**.

Figure 9:
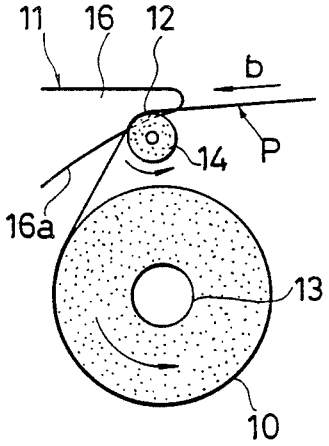
FIG. 9 is a view similar to FIG. 8, but for explanation of a feed mode in which the recording medium is transported in a reverse-feed direction.

A reverse-feed mode will next be described, in which the recording medium P is transported in the reverse-feed direction b. When the platen 10 is rotated in the counterclockwise direction as viewed in FIG. 9 by the drive motor or by the platen knob 34 fixedly mounted on the rotary shaft 13 for the platen 10, the platen gear 26 is rotated in the counterclockwise direction. The idle gear 27 in mesh with the platen gear 26 is rotated in the clockwise direction opposite to the platen gear 26. The roller gear 29 in mesh with the idle gear 27 is rotated in the same counterclockwise direction as the platen gear 26. Rotation of the roller gear 29 in the counterclockwise direction causes the coil spring 33 to be loosened, thereby preventing the rotation of the roller gear 130 in the counterclockwise direction from being transmitted to the support shaft 14. The recording medium P wound about the platen 10 and held between the discharge rollers 12 and the guide surfaces **16*a* of the respective guide ribs 16 on the top cover 11 is transported in the reverse-feed direction b by the rotation of the platen 10 in the counterclockwise direction. The discharge rollers 12 do not receive the rotational force from the platen 10, but are rotated by the recording medium P transported in the reverse-feed direction b. The discharge rollers 12 rotated by the recording medium P transported in the reverse-feed direction b impart frictional resistance to the recording medium P between the discharge rollers 12 and the guide surfaces 16*a* of the respective guide ribs 16 on the top cover 11, thereby applying back-tension to the portion of the recording medium P between the discharge rollers 12 and the platen 10. Thus, it is possible to prevent the portion of the recording medium P between the discharge rollers 12 and the platen 10**, from slackening.

Figure 10:
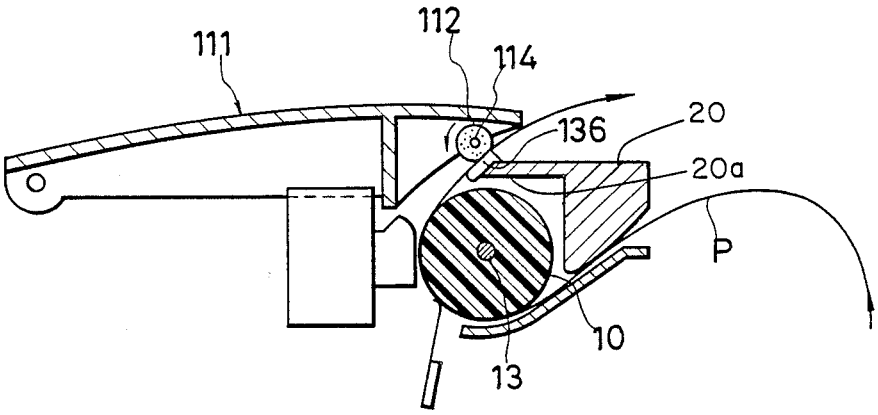
FIG. 10 is a view similar to FIG. 4, but showing another embodiment of the invention.
Figure 11A:
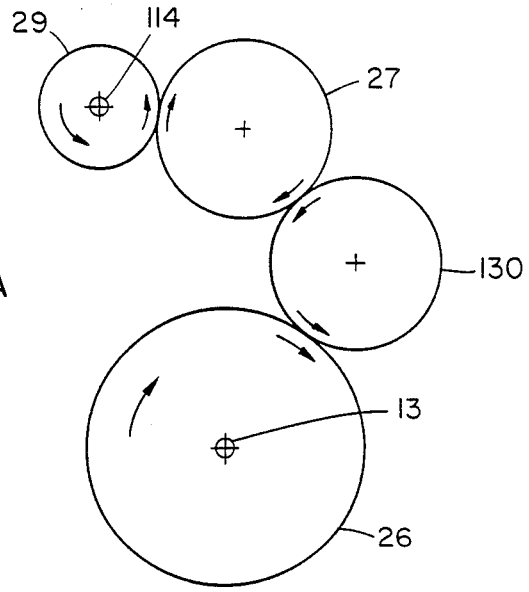
FIGS. 11A and 11B are schematic views of gear arrangements that include an additional intermediate gear between the shafts of the platen and the discharge rollers of the embodiment of FIG. 10.
Figure 11B:
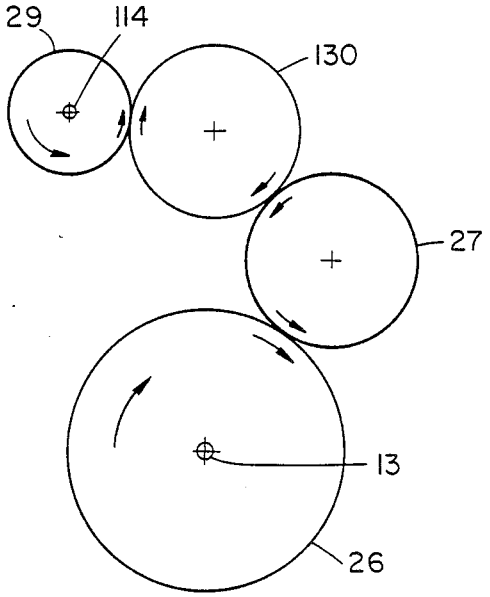

FIG. 10 shows another embodiment of the invention. In this embodiment, a support shaft 114 having fixedly mounted thereon discharge rollers 112 (only one shown) is supported rotatably by a top cover 111. A rotation transmitting mechanism arranged between the rotary shaft 13 of the platen 10 and the support shaft 114 comprises an intermediate gear in addition to the gears 26, 27 and 29 shown in FIG. 6. The intermediate gear 130 is arranged between the platen gear 26 and the idle gear 27 (FIG. 11A) or between the idle gear 27 and the roller gear 29 (FIG. 11B). Accordingly, the rotation transmitting mechanism is so arranged that rotation of the platen 10 in the normal direction transporting the recording medium P in the normal-feed direction a is transmitted to the support shaft 114 of the discharge rollers 112, to rotate the latter in a direction opposite to the rotational direction of the platen 10. Further, a plurality of ribs 136 associated respectively with the discharge rollers 112 are fixedly mounted to the forward edge of the projection 20*a* of the receiving section 20. The discharge rollers 112 cooperate with the ribs 136 to clamp therebetween the recording medium P. The remaining structure and construction of the embodiment illustrated in FIG. 10 are the same as those of the previously described embodiment, and will not be repeated here.

Still another objects and advantages of the present invention will become readily apparent to those skilled in this art from the preceding detailed description, wherein only the preferred embodiments of the invention are illustrated and described, as aforementioned, simply by way of presenting the best modes contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not a restrictive, the invention being defined solely by the claims appended hereto.

What is claimed is:

1. A printer for printing information onto a recording medium, comprising:

a platen about which said recording medium is wound, said platen being rotatable about its longitudinal axis in a normal direction and a reverse direction opposite to said normal direction, wherein rotation of said platen in said normal direction causes said recording medium to be transported along a predetermined transport path in a normal-feed direction, while rotation of said platen in said reverse direction causes said recording medium to be transported along said predetermined transport path in a reverse-feed direction opposite to said normal-feed direction;

means arranged adjacent said platen for printing information onto a portion of said recording medium on said platen;

discharge roller means arranged above and spaced from said platen for rotation about an axis parallel to said longitudinal axis of said platen; and means for rotating said discharge roller means at a peripheral speed higher than that of said platen, said predetermined transport path extending about said discharge roller means;

said means for rotating including rotation transmitting means arranged between said platen and said discharge roller means for transmitting rotation of said platen to said discharge roller means, said rotation transmitting means including one-way clutch means for permitting rotation of said platen in said normal direction to be transmitted to said discharge roller means to rotate the same thereby feeding said recording medum in said normal-feed direction, but for preventing rotation of said platen in said reverse direction from being transmitted to said discharge roller means.

2. A printer according to claim 1, further comprising:

a top cover movable between open and closed positions, said discharge roller means being arranged between said top cover and said platen.

3. A printer according claim 2, wherein:

when said top cover is in said closed position, said discharge roller means cooperates with said top cover to clamp therebetween said recording medium.

4. A printer according to claim 3, wherein:

said discharge roller means is composed of a plurality of discharge rollers arranged in spaced relation to each other along said axis about which said discharge roller means is rotatable.

5. A printer according to claim 4, wherein:

said top cover is provided with a plurality of guide rib means associated respectively with said discharge rollers, and wherein when said top cover is in said closed position, said discharge rollers cooperate with said guide rib means to clamp therebetween said recording medium.

6. A printer according to claim 5, wherein:

each of said guide rib means includes a pair of guide ribs between which a corresponding one of said discharge rollers is arranged.

7. A printer according to claim 6, wherein:

each of said guide ribs has a curved edge facing toward said platen, the curved edge being formed into a guide surface for said recording medium.

8. A printer according to claim 7, wherein:

said discharge rollers are so arranged that a diameter of each of said discharge rollers is larger than a shortest straight distance between the curved guide surface of each guide rib and said axis about which said discharge roller means is rotatable.

9. A printer according to claim 1, further comprising:

support shaft extending parallel to said longitudinal axis of said platen, said discharge roller means being mounetd on said support shaft for rotation therewith, wherein said rotation transmitting means is arranged between said support shaft and said platen.

10. A printer according to claim 9, wherein:

said rotation transmitting means comprises a gear train arranged between said platen and said support shaft, said gear train including a roller gear associated with said support shaft, and wherein said one-way clutch means is arranged between said support shaft and said roller gear.

11. A printer according to claim 10, wherein:

said one-way clutch means is composed of a coil spring having axial one end thereof in which an axial end of said support shaft is fitted forcibly, and wherein said roller gear is formed with a boss having an axis extending in coaxial relation to an axis of said support shaft, said boss being forcibly fitted in the other axial end of said coil spring.

12. A printer according to claim 1, wherein:

said rotation transmitting means is so arranged as to transmit the rotation of said platen in said normal direction to said discharge roller means to rotate the same in the same direction as said platen.

13. A printer according to claim 1, wherein:

said rotation transmitting means is so arranged as to transmit the rotation of said platen in said normal direction to said discharge roller means to rotate the same in the opposite direction to said platen.

14. A printer according to claim 13, further comprising:

rib means arranged in fixed positional relation to said platen, wherein said discharge roller means cooperates with said rib means to clamp therebetween said recording medium.

15. A printer according to claim 14, further comprising:

a top cover movable between open and closed positions, said discharge roller means being arranged between said top cover and said platen, wherein said discharge roller means is rotatably mounted to said top cover.

* * * * *